United States Patent [19]

Jacuzzi

[11] 4,126,925

[45] Nov. 28, 1978

[54] SKIMMER ASSEMBLY

[75] Inventor: Virgil Jacuzzi, Islington, Canada

[73] Assignee: Jacuzzi Bros. Incorporated, Little Rock, Ark.

[21] Appl. No.: 623,398

[22] Filed: Oct. 17, 1975

[51] Int. Cl.[2] ..... B23P 19/00

[52] U.S. Cl. ..... 29/428; 4/172.15; 210/169

[58] Field of Search ..... 4/172.15–172.17; 210/121, 169, 242 S; 29/428

[56] References Cited

U.S. PATENT DOCUMENTS

| | | | |
|---|---|---|---|
| 2,579,304 | 12/1951 | Crawford | 210/169 X |
| 3,268,079 | 8/1966 | Sharrow, Jr. | 210/169 |
| 3,428,178 | 2/1969 | Nash | 210/121 |
| 3,481,470 | 12/1969 | Valois | 210/169 |
| 3,508,661 | 4/1970 | Diemond et al. | 210/169 |
| 3,616,916 | 11/1971 | Greene | 210/121 |
| 3,633,749 | 1/1972 | Panosh | 210/169 X |
| 3,741,391 | 6/1973 | Donsbach | 210/242 S X |
| 3,782,553 | 1/1974 | Brekke | 210/242 S X |

*Primary Examiner*—Frank A. Spear, Jr.
*Assistant Examiner*—Richard W. Burks
*Attorney, Agent, or Firm*—Edward Brosler; Merwyn Brosler

[57] ABSTRACT

A skimmer assembly adapted for installation through an opening in a pool wall from the rear side thereof to mask the otherwise exposed edges of the wall opening, includes a circular type weir involving a float having means for offering resistance to dropping of the float in response to operation of the pool pump, whereby to minimize and stabilize the layer of water flowing over the weir.

1 Claim, 9 Drawing Figures

SKIMMER ASSEMBLY

The present invention relates to swimming pool installations and more particularly to a skimmer assembly for installation in the wall of a pool to promote skimming of the surface of a pool in order to remove floating debris which may have accumulated therein. The surface water of a pool is cause to enter the skimmer and flow over a weir carrying such debris with it, following which, the larger bits of debris are removed by a basket through which the water flows on its way to the pool pump.

Efficiency in skimming can be realized by reducing the thickness of the layer of water flowing over the weir, for this results in higher velocities at the surface to give better skimming action.

Conventional type skimmers utilizing hinged weirs, oscillate freely with wave motion and consequently are not conducive toward causing a thin layer of water to flow over the weir, still less a thin layer which is more or less stable.

Circular type weirs respond to a differential force attributable for the most part to bouyancy of the water within the tunnel as opposed by suction of the pool pump when operating, and any changes in the level of water entering the tunnel attributable, for example, to wave motion, will cause changes in position of the float within the float housing. The inertia thus imparted to the float will cause it to bounce or oscillate, whereby the efficiency of the float as a weir becomes impaired because, for one thing, the thickness of the layer of water flowing over the float will fluctuate accordingly.

Available skimmer assemblies present additional problems which the present invention seeks to remedy.

Among the objects of my invention are:

(1) To provide a novel and improved skimmer assembly;

(2) To provide a novel and improved skimmer assembly utilizing a circular float type weir;

(3) To provide a novel and improved skimmer assembly which will provide a substantially stabilized thin sheet of water flowing over the weir to enhance the efficiency of skimming;

(4) To provide a novel and improved skimmer assembly which can be installed in a pool wall so as to eliminate exposed edges of the pool wall opening;

(5) To provide a novel and improved method of installing a skimmer assembly in a pool wall;

(6) To provide a novel and improved skimmer assembly which will permit of a vacuuming operation without removal of the strainer basket from the assembly;

(7) To provide a novel and improved circular float type weir assembly for use in a skimmer to enhance the efficienty of skimming; and (8) To provide a novel and improved circular float type weir in which bouncing or oscillation in response to sudden changes in water level are essentially eliminated.

Additional objects of my invention will be brought out in the following description of a preferred embodiment of the same, taken in conjunctin with the accompanying drawings wherein.

Figure 1:
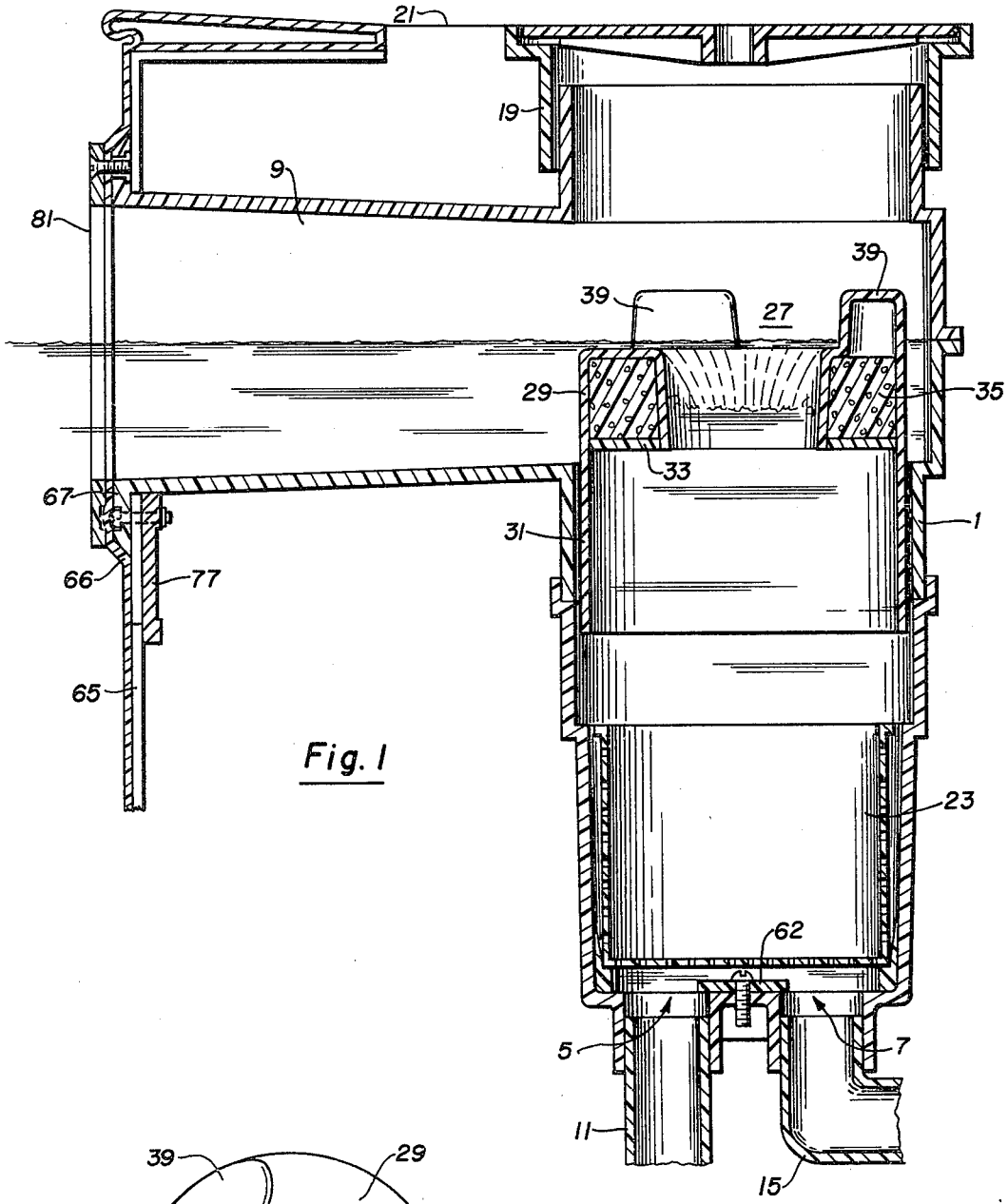
FIG. 1 is a view in section through a skimmer assembly embodying the features of the present invention, illustrated installed in a pool of the liner type.
Figure 2:
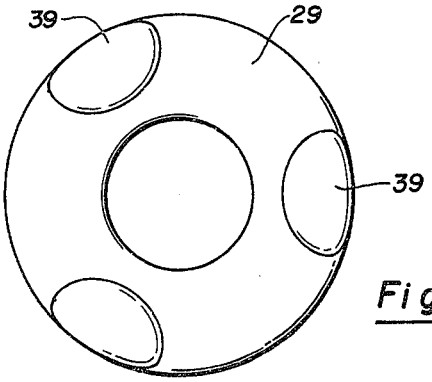
FIG. 2 is a plan view of the weir assembly depicted in the skimmer assembly of FIG. 1.

Referring to the drawings for details of my invention in its preferred form, the embodiment illustrated is designed primarily for installation in a pool of the liner type.

The skimmer assembly thus illustrated involves a substantially cylindrical housing 1 terminating in a bottom 3 provided with a pair of openings 5, 7, the housing being associated with a tunnel 9 extending laterally therefrom at an intermediate location thereof, both the cylindrical housing and tunnel preferably being of plastic, reinforced by external molded ribbing.

One opening 5 is for connection in the conventional manner via a pipe 11 to the drain in the floor of a swimming pool, while the other opening 7 is for connection in a conventional manner via a pipe 15 to the swimming pool pump.

An adjustable cover assembly 19 slidably fits the upper end of the housing to enable adjustment as to height to match up with the pool deck 21.

Further, in accordance with conventional practice, a strainer basket 23 is received in the bottom of the weir assembly housing to intercept leaves and other floating debris passing through.

Installed just above the strainer basket is a floating weir assembly 27.

The weir assembly comprises a circular or doughnut shape float housing in the form of an inverted circular trough 29 provided with a depending skirt 31 slidably fitting the housing but with sufficient clearance so as not to impair vertical movements of the weir assembly when functioning. A ring shaped closure 33 is adapted to fit the open end of the trough.

Within the float housing is a ring 35 of plastic foam, retained in position by the insertable closure 33.

Up to this point, the skimmer assembly will function in a more or less conventional manner when installed in a pool wall, and properly connected to the pool pump. It will fill up to the level of the water in the pool, with the pool pump in a quiescent state, and the weir assembly will float with its upper portion slightly above the level of the surrounding water.

Upon starting up of the pump, water will be withdrawn from the weir assembly housing to the point that the weir assembly will now be somewhat submerged below the level of the water in the tunnel, thereby causing a flow of water over the weir into the weir assembly housing and to the pump, via the strainer basket which will remove any debris such as leaves and the like.

The weight of the water pouring over the weir will cause a slight additional drop in the position of the weir until a position of equalibrium is attained. The combined effect of the pump and the weight of the layer of water flowing over the weir results in a relatively thick layer of water flowing over the weir, thereby cutting down velocity of flow and impairing effecienty of skimming.

Aggravating this situation, is the fact that the thickness of such layer of water flowing over the weir will fluctuate in response to wave motion imparted to the incoming water by prevailing conditions in the pool, and such fluctuations will cause the float to respond and oscillate vertically in what may be termed bouncing, which, in turn, will further aggrevate the situation. Thus, wave motion stimulates such chain of events, each stage of which produces an additional adverse effect on the skimming ability of the skimmer assembly.

For ameliorating these adverse conditions, the float 29 is provided with additional buoyancy means 39 at preferably equally spaced locations about the upper surface thereof, and to a height such that they will be only partially submerged during functioning cycles of the weir assembly.

Such additional buoyancy may take the form of additional sections of foam plastic affixed to the upper surface of the float housing, or may take the form of air chambers molded into the float housing as illustrated.

While the mode of operation of the embodiment described above is not too clear, it is believed that, by reason of the clearance existing between the skirt and the proximate wall of the weir assembly housing, the buoyancy force against the bottom 33 of the float of the weir assembly will always be that exerted by the water at the level of the water in the tunnel, and that this buoyancy force will be opposed by the suction force of the pump when the pump is functioning, plus the weight of the layer of water flowing over the weir. Thus the resulting differential effect upon the float, will serve to lower the float to a point below the level of the water in the tunnel.

However, as the float proper submerges, the air chambers 39 then begin to submerge and add to the prevailing buoyancy force exerted upon the float, thereby reducing the ability of the pump to drop the float to the position which it would normally occupy in a conventional or prior art weir assembly, with the result that a thinner sheet of water will flow over the weir and with greater velocity, which is what the present invention seeks and what is desired in a weir assembly.

Figure 4:
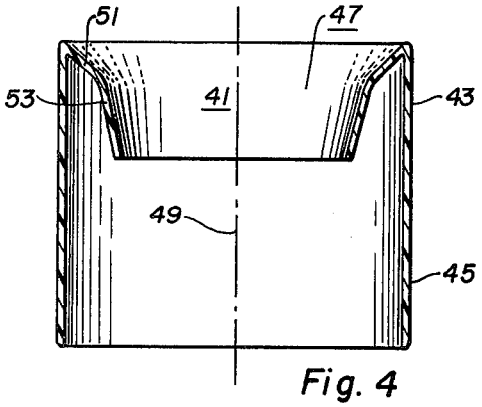
FIG. 4 is a view in section thoough an alternative weir assembly capable of use in place of the weir assembly depicted in FIG. 1.
Figure 5:
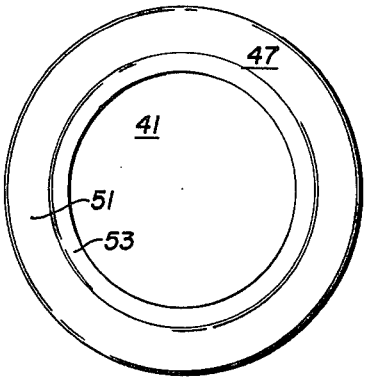
FIG. 5 is a plan view of the weir assembly of FIG. 4.

In the second embodiment of the invention as depicted in FIGS. 4 and 5 of the drawings, the weir assembly takes on much simpler construction, and involves an inverted circular trough 41 with a vertical outside wall 43 extended to provide a depending skirt 45, while the inner wall 47 of the weir assembly slopes in the direction of the longitudinal axis 49 in such manner as to maintain contact with the incoming water during functioning cycles of the weir assembly, whereby to prevent agitation of the water and creation of air bubbles which might adversely effect pump operation.

Preferably the inner wall is formed with an initial portion 51 at an approximate angle of 45° with the vertical outer wall, and a second portion 53 making an angle of approximately 10° with said outer wall.

With this simplified design of the second embodiment, the float characteristic is primarily attributed to the fact that when installed in the weir assembly housing, air will be trapped within the inverted channel to create an air chamber, thus providing the necessary buoyancy.

In this embodiment the necessary additional buoyancy force to acheive objects of the present invention, is attributed to the fact that the air, being trapped, becomes an air cushion having the qualities of a spring, and will, accordingly, due to compression of this air cushion, offer resistance to dropping of the float by action of the pump.

In both embodiments, dropping of the weir is resisted to a much greater degree than in prior art weir assemblies of similiar types, with the resut that in each embodiment, the layer of water flowing over the weir, will be thinner with a resulting increase in the velocity of water over the weir and greater stability to the weir assembly.

Utilizable in place of either of the above described weir assemblies, for use in vacuuming the floor of the pool, there is provided a vacuum cover 57 adapted to be removably seated on a built in shoulder 59 in the wall of the weir assembly housing, just above the strainer basket, and sealed to such shoulder by a suitable gasket. This vacuum cover includes a vertical neck 60 for attachment of a vacuum hose 61 which connects to a pool vacuum cleaner.

When it becomes desirable to vacuum such pool, it is essential to block off the main drain line 11 of the pool, and this is accomplished by a trimmer valve 62 located at the bottom of the housing and adapted to swing from a position completely closing the main drain line from the pool, to a position completely closing the pump suction line. Then by starting the pump, the vacuum sweeper can be moved along the bottom of the pool to vacuum the same, and any debris picked up by the vacuum sweeper, will be strained through the strainer basket which will remove the larger items, it being important to note in this connection, that the strainer basket need not be removed when vacuuming, as is necessary in prior skimmer assemblies of this type.

When it becomes necessary to drain the pool itself, then all that is necesary to do is to plug up the neck opening of the vacuum by means of an appropriate cap and then exposing the main drain line 11 from the pool, to the pump suction opening 7 by swinging the valve to a midpoint between the two.

In conjunction with the foregoing features of the skimmer assembly of the present invention, the skimmer assembly is so designed as to greatly facilitate installation thereof in the wall of a pool, particularly a pool of the liner type wherein the wall is fabricated of metal panel 65 which is then covered with a liner 66 of plastic or comparable material.

Toward this end, the tunnel 9, at its entrance end, is of rectangular configuration, bordered along both dimensions by mounting flanges 67, 69.

At the location on the pool wall for mounting of the skimmer assembly, the metal panel is provided with a rectangular opening 71 whose one dimension is longer than that of the corresponding tunnel flanges, and whose other dimension is less than the remaining tunnel flanges and preferably approximately the comparable dimension of the mouth of the tunnel. In the preferred embodiment, the longer flanges exceed in length, the longer dimension of the opening.

Figure 7:
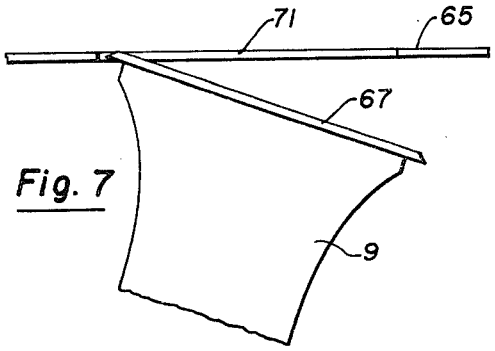
FIGS. 7, 8 and 9 are views depicting a novel method of installing a skimmer assembly in a wall of a liner type pool.
Figure 8:
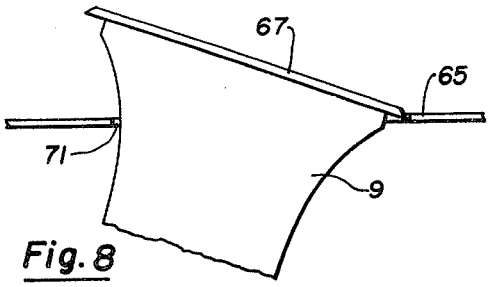
Figure 9:
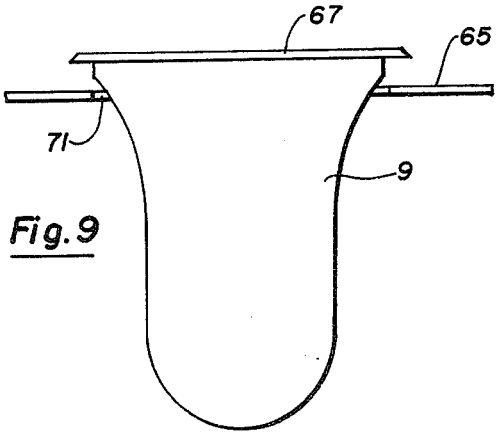
Figure 3:
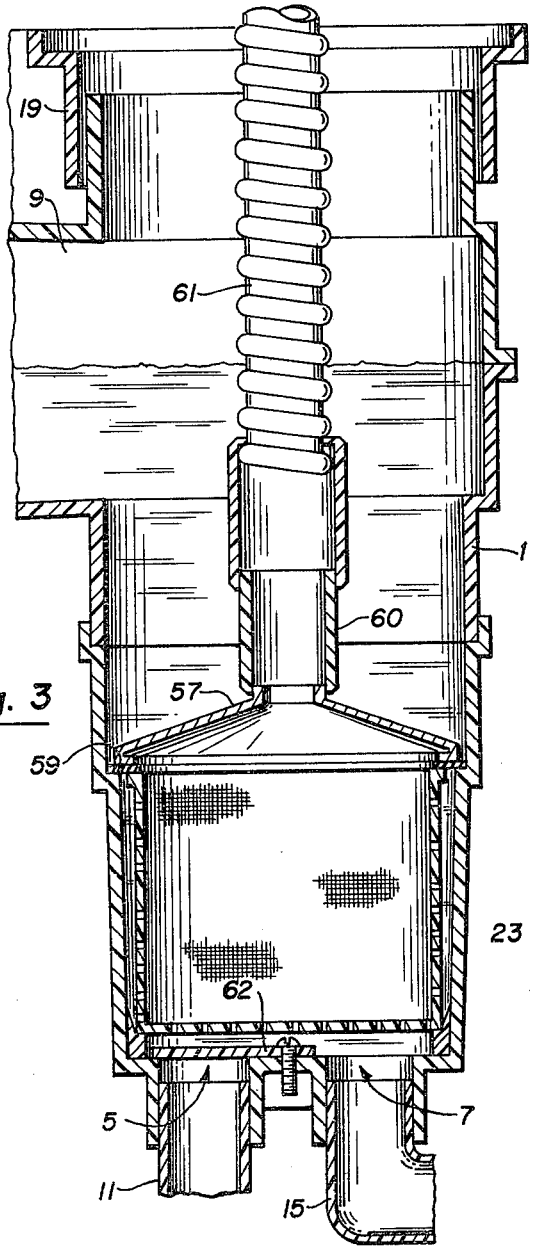
FIG. 3 is a fragmentary view in section depicting the substitution of a vacuum attachment for use in lieu of the weir assembly of FIG. 1, for use in vacuuming a pool.
Figure 6:
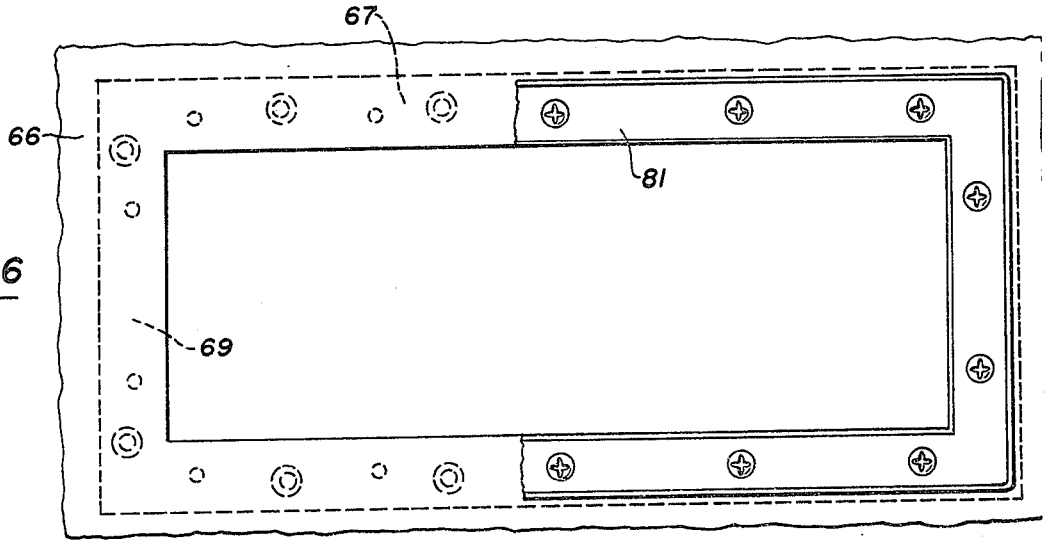
FIG. 6 is a front view partly broken away of the skimmer assembly installed in a pool wall.

When the dimensions of the wall opening are so related to the length of the flanges bordering the mouth of the tunnel, the skimmer assembly can be installed from the rear side of the pool wall by first inserting one of the flanges 69 of less length than the corresponding dimension of the wall opening (See FIG. 7) and following this by passing the opposite flange through the opening (See FIG. 8), which results in the entire flanged end of the tunnel appearing on the pool side of the wall (See FIG. 9).

The entire skimmer assembly is then retracted to bring three of the flanges into contact with the metal panel 65 of the wall, following which, the skimmer assembly may be mounted to the metal panel by bolts through the metal panel and contacting flanges.

This leaves a slim opening along the remaining flange, which opening is then closed by a backing plate 77 applied against the rear of this flange and the proximate edge of the metal panel opening, to which the backing plate is affixed by mounting bolts.

Following such mounting of the skimmer assembly to the metal panel of the pool wall, the lining 66 is applied and when applied to the metal panel, it is provided with an opening of a size and shape matching the entrance to the tunnel, whereby such liner will cover, conceal and protect not only the backing plate 77 and the opening which it has covered, but also all the flanges of the tunnel, to which the edges of the opening in the lining are clamped under pressure by a matching frame 81 and sealing gasket which are bolted to the flanges of the tunnel. By installing the skimmer assembly in this manner, the entire skimmer assembly may be preassembled and then installed in a very simple and direct manner to the pool wall.

From the foregoing description of my invention in its preferred form, it will be appreciated that the same fulfills all the objects attributed thereto, and while I have illustrated and described my invention in considerable details, it will be appreciated that the same is subject to alteration and modification without departing from the underlying principles involved, and I, accordingly, do not desire to be limited in my protection to the specific details illustrated and described, except as may be necessitated by the appended claims.

I claim:

1. The method of installing a skimmer assembly in a swimming pool wall comprising forming in said wall, a rectangular skimmer opening of predetermined length and width dimensions, fabricating a skimmer assembly having a tunnel terminating in a rectangular opening at its intake end, bordered by a flange, said tunnel opening plus its flanges having one of its dimensions exceeding the corresponding dimension of said wall opening and its other dimension slightly less than the corresponding dimension of said wall opening, inserting said intake end of said tunnel through said wall opening from the rear side thereof by first inserting one of the sides of less dimension than said opening, through said opening, followed by the opposite side, then backing up the skimmer assembly to bring the flanges of said opposite sides plus one flange of a connecting side, into engagement with the front side of said wall, leaving a slim opening along the remaining flange, affixing said skimmer assembly via its wall engaging flanges, to said wall, closing said slim opening with a closure, and then covering said wall and closure with a liner.

* * * * *